US005424699A

United States Patent [19]

Goble

[11] Patent Number: 5,424,699

[45] Date of Patent: Jun. 13, 1995

[54] BLOW-OFF TERMINAL FOR A CIRCUIT BREAKER

[75] Inventor: Christopher K. Goble, Marion, Iowa

[73] Assignee: Square D Company, Palatine, Ill.

[21] Appl. No.: 195,296

[22] Filed: Feb. 14, 1994

[51] Int. Cl.[6] ..... H01H 75/00

[52] U.S. Cl. ..... 335/16; 335/195; 335/147; 218/22

[58] Field of Search ..... 335/16, 147, 195; 200/144 R, 147 R

[56] References Cited

U.S. PATENT DOCUMENTS

| | | | |
|---|---|---|---|
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,417,223 | 11/1983 | Bancalari | 335/195 |
| 4,511,774 | 4/1985 | Forsell | 200/147 R |
| 4,740,768 | 4/1988 | Morris et al. | 335/22 |
| 4,975,553 | 12/1990 | Oster | 200/147 R |
| 5,003,139 | 3/1991 | Edds et al. | 200/401 |
| 5,073,764 | 12/1991 | Takahashi et al. | 335/16 |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,245,302 | 9/1993 | Brune et al. | 335/35 |

*Primary Examiner*—Lincoln Donovan

*Attorney, Agent, or Firm*—Larry I. Golden; Kareem M. Irfan

[57] ABSTRACT

A blow-off terminal includes a flat conductive tang, a flat conductive input section, and a flat conductive output section. The input section includes a pair of generally parallel U-shaped strips. Each of the pair of strips includes first and second end portions and a center portion bridging the first and second end portions. The first and second end portions and the center portion of each of the pair of strips are generally co-planar, and the tang and the output section are generally co-planar. The output section is elongated and includes first and second ends, the first end being disposed closer to the tang than the second end. The first end portions of the strips are connected perpendicular to opposite sides of the tang, and the second end portions are connected perpendicular to opposite sides of the second end of the output section. A stationary contact is mounted to the surface of the output section.

17 Claims, 1 Drawing Sheet

BLOW-OFF TERMINAL FOR A CIRCUIT BREAKER

FIELD OF THE INVENTION

The present invention relates generally to circuit breakers and, more particularly, to an improved blow-off terminal for a circuit breaker.

BACKGROUND OF THE INVENTION

Use of circuit breakers is widespread in modern-day residential, commercial and industrial electric systems, and they constitute an indispensable component of such systems toward providing protection against over-current conditions. Various circuit breaker mechanisms have evolved and have been perfected over time on the basis of application-specific factors such as current capacity, response time, and the type of reset (manual or remote) function desired of the breaker.

A circuit breaker employs a pair of mating contacts which establish a current path therebetween during normal operation of the circuit into which the breaker is installed. In response to a high current condition in the circuit, however, the mating contacts separate one another to interrupt the current path therebetween. One of the contacts is a movable contact connected to the end of an elongated rotatable blade, while the other of the contacts is a stationary contact attached to a fixed blow-off terminal. In response to the high current condition, the blow-off terminal provides an electromagnetic repulsion toward the rotatable blade. In one type of blow-off terminal, shown in FIG. 1, a blow-off terminal 10 is configured in the form of a U-shaped loop. The current flow in the blow-off terminal 10 is depicted by the arrows in FIG. 1. It can be seen that the current flow reverses directions in passing from the input section 12 to the output section 14 of the terminal 10. This current reversal causes an electromagnetic repulsion between the input and output sections 12, 14. During normal circuit operation, the current flow from the output section 14 passes through the stationary contact 16 to a mating movable contact (not shown) of a rotatable blade. During a high current condition, the terminal 10 repels the rotatable blade to separate the movable contact from the stationary contact 16. This separation is accelerated by the U-shaped configuration of the blow-off terminal 10.

A drawback of the blow-off terminal 10 is that it is not conducive to manufacturing. In one manufacturing technique, the terminal 10 is fabricated by imparting successive bends perpendicular to the developed length of the raw metal material used for its fabrication. In FIG. 1, these bends are designated by the reference numerals 18 and 20. While this process economizes material usage, the forming process becomes more difficult with each subsequent bend. The manufacturer must accommodate brazing operations either by partially forming the terminal with the bend 18, and then proceed to either braze the contact 16 to the output section 14 or at least provide some kind of clearance holes so that the contact 16 can later be attached to the output section 14. The terminal 10 must then have a final forming operation where the bend 20 is imparted thereto. This final forming operation is difficult to perform because the contact 16 is already in place and because the terminal material has been partially annealed from the brazing operation.

In another manufacturing technique, the terminal 10 is formed from two or more separate pieces which are either mechanically fastened or welded together. Drawbacks of this technique are that it is part intensive and it can be a source of high resistance within the assembled terminal.

Accordingly, there is a need for a blow-off terminal which can be implemented without the aforementioned shortcomings.

SUMMARY OF THE INVENTION

The present invention provides a blow-off terminal which is cost-effective and easy to manufacture.

The present invention further provides a blow-off terminal which is configured to reverse the direction of current flow as the current passes from the input section to the output section of the terminal.

In one implementation of the present invention, a blow-off terminal includes a flat conductive tang, a flat conductive input section, and a flat conductive output section. The input section includes a pair of generally parallel U-shaped strips. Each of the pair of strips includes first and second end portions and a center portion bridging the first and second end portions. The first and second end portions and the center portion of each of the pair of strips are generally co-planar. The tang and the output section are substantially parallel to each other. The output section is elongated and includes first and second ends, the first end being disposed closer to the tang than the second end. The first end portions of the strips are connected perpendicular to opposite sides of the tang, and the second end portions are connected perpendicular to opposite sides of the second end of the output section. A stationary contact is connected to the surface of the output section.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
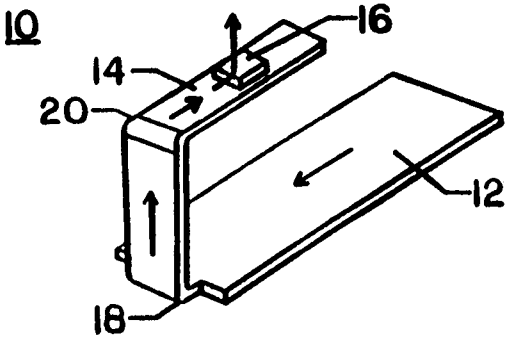
FIG. 1 is a perspective view of one type of prior art blow-off terminal.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DETAILED DESCRIPTION OF THE FIGURES

Figure 2:
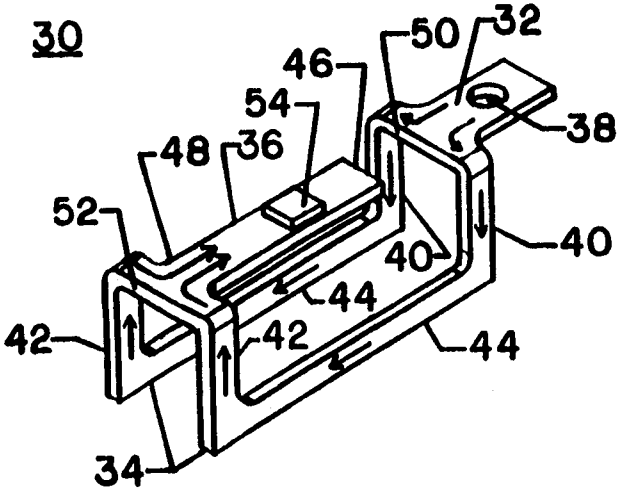
FIG. 2 is a perspective view of a blow-off terminal embodying the present invention.

Turning now to the drawings, FIG. 2 illustrates a blow-off terminal 30 including a flat conductive tang 32, a conductive input section 34, and a flat conductive output section 36. The tang 32 is provided with an aperture 38 for mounting the terminal 30 within a circuit breaker enclosure. The input section 34 includes a pair of parallel U-shaped strips, each of which includes a first end 40, a second end 42, and a center portion 44 bridging the first and second ends 40, 42. In each of the pair of U-shaped strips, the first end 40, the second end 42, and the center portion 44 are co-planar, and the first and second ends 40, 42 are perpendicular to the center portion 44.

Both the tang 32 and the output section 36 are coplanar, rectangular in shape, and elongated in the direction of current flow such that the longitudinal axis of symmetry of the tang is co-linear with the longitudinal axis of symmetry of the output section 36. Furthermore, the tang 32 and the output section 36 are positioned halfway between the two U-shaped strips of the input section 34 such that the U-shaped strips are symmetrically disposed about the tang 32 and the output section 36. The first end portions 40 of the respective U-shaped strips are integrally formed with the opposing longitudinal sides of the tang 32 at an end 50 thereof. Similarly, the second end portions 42 of the respective U-shaped strips are integrally formed with the opposing longitudinal sides of the output section 36 at an and 52 thereof. The tang 32 extends from its end 50 in a direction away from the input section 34 so that current passing through the tang 32 and entering the input section 34 does not reverse direction. In contrast, the output section 36 extends from its end 52 in a direction toward the tang 32 so that current passing through input section 34 and entering the output section 36 reverses its direction.

The current path through the blow-off terminal 30 will now be described in greater detail. Current from the circuit into which the terminal 30 is installed first flows into the tang 32. Next, if the terminal 30 has a perfectly symmetrical design, the current splits into two parts with one half of the current flowing through one of the U-shaped strips of the input section 34 and the other half flowing through the other of the U-shaped strips. After flowing through their respective U-shaped strips, the two current halves rejoin while flowing into the output section 36. During normal circuit operation, the current flows through the output section 36 and through a stationary contact 54 to a mating movable contact (not shown) of a rotatable blade (not shown). Such a rotatable blade is described in U.S. patent application Ser. No. 08/195,959, entitled "Blade Suspension Assembly for a Circuit Breaker", filed concurrently herewith, assigned to the instant assignee, and incorporated herein by reference. The stationary contact 54 is mounted to the surface of the output section 36 at a slightly off-center position by attachment means such as solder.

It can be seen that the geometry of the blow-off terminal 30 is configured to reverse the direction of the current flow in the portion of the terminal closest to the rotatable blade. As indicated by the arrows in FIG. 2, the current flow reverses direction while passing from the input section 34 to the output section 36. This current reversal causes an electromagnetic repulsion between the input section 34 and the output section 36. During a high current condition, this electromagnetic repulsion accelerates the rotation of the blade so as to improve circuit interruption performance.

Figure 3:
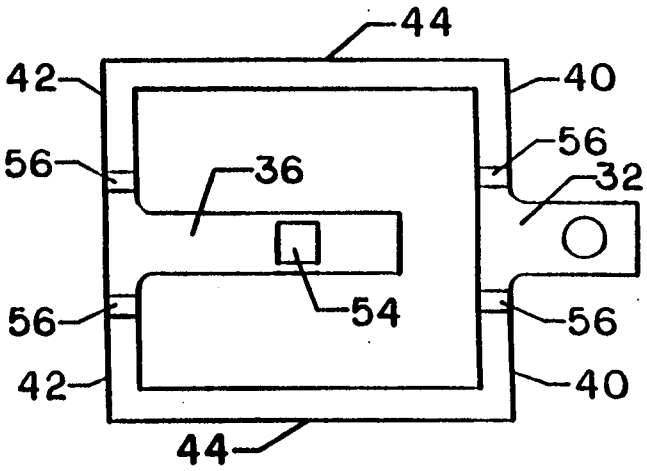
FIG. 3 is a top view of the blow-off terminal in FIG. 2 prior to imparting four bends thereto in the fabrication process.

The blow-off terminal 30 is manufactured by first stamping a sheet of raw metal material into the shape depicted in FIG. 3. At this point, the tang 32, the output section 36, and the two U-shaped strips of the input section 34 are all disposed in the same plane. Next, four orthogonal bends 56 are imparted to the configuration in FIG. 3 so that the U-shaped strips of the input section 34 are parallel to each other and perpendicular to both the tang 32 and the output section 36. Since these bends are parallel, not perpendicular, to the developed length of the raw material, the terminal 30 (without the contact 54) is completely formed before brazing the contact 54 to the output section 36. This subsequent contact brazing operation is easily accomplished because the parallel U-shaped strips of input section 34 allow access to both the upper and lower surfaces of the output section 36. This, in turn, permits the contact 54 to be accurately positioned on the output section 36. In contrast, it would be difficult to perform the contact brazing operation for the terminal 10 in FIG. 1 after completely forming the raw material because the input section 12 of that terminal 10 inhibits access to the lower surface of the output section 14.

While the present invention has been described with reference to one or more particular embodiments, those skilled in the art will recognize that many changes may be made thereto without departing from the spirit and scope of the present invention. For example, in order for the blow-off terminal 30 to properly function, it is not necessary for the U-shaped strips of the input section 34 to be constructed parallel to each other. Furthermore, if desired, the input section 34 can be manufactured with only one U-shaped strip. Also, instead of configuring this single strip into a U-shape with a first end 40, a second end 42, and a central portion 44, the strip can be configured in a different shape such as a semicircle. Each of these embodiments and obvious variations thereof is contemplated as falling within the spirit and scope of the claimed invention, which is set forth in the following claims.

What is claimed is:

1. A blow-off terminal for a circuit breaker, comprising:

a flat conductive tang extending in a generally longitudinal direction;

a flat conductive output section substantially parallel to said tang and extending in said longitudinal direction, said output section having an electrical contact mounted thereto, said output section having opposing longitudinal sides and first and second ends bridging said opposing longitudinal sides, said first end of said output section being disposed closer to said tang than said second end thereof; and a conductive input section having a pair of generally planar U-shaped strips symmetrically disposed about said tang and said output section, each of said pair of strips including first and second ends, said first ends of said pair of strips being connected substantially perpendicular to opposite longitudinal sides of said tang, said second ends of said pair of strips being connected substantially perpendicular to said opposing longitudinal sides of said output section.

2. The blow-off terminal of claim 1, wherein said tang and said output section are substantially co-planar.

3. The blow-off terminal of claim 2, wherein said tang and said output section are generally rectangular in shape and are elongated in the same direction.

4. The blow-off terminal of claim 3, wherein said tang and said output section are disposed such that a longitudinal axis of symmetry of said tang is substantially co-linear with a longitudinal axis of symmetry of said output section.

5. The blow-off terminal of claim 1, wherein said U-shaped strips are substantially parallel to each other.

6. The blow-off terminal of claim 1, wherein said tang is elongated and includes first and second ends, said second end of said tang being disposed closer to said output section than said first end of said tang, said first ends of said pair of strips being connected substantially perpendicular to opposite sides of said tang adjacent said second end thereof.

7. The blow-off terminal of claim 1, wherein said tang, said output section, and said input section are integrally formed with one another.

8. A blow-off terminal for a circuit breaker, comprising:

a flat rectangular conductive tang having a longitudinal axis of symmetry;

a flat rectangular conductive output section substantially parallel to said tang and having an electrical contact mounted thereto, said output section having a longitudinal axis of symmetry substantially co-linear with said longitudinal axis of symmetry associated with said tang, said output section having first and second ends substantially perpendicular to said longitudinal axis of symmetry of said output section and having a pair of opposing longitudinal sides substantially parallel to said axis of symmetry of said output section, said tang having a pair of longitudinal sides substantially parallel to said axis of symmetry associated with said tang, said first end of said output section being disposed closer to said tang than said second end thereof; and a conductive input section having a generally planar strip with first and second ends, said first end of said strip being connected substantially perpendicular to one of said pair of longitudinal sides of said tang, said second end of said strip being connected substantially perpendicular to a respective one of said pair of longitudinal sides of said output section.

9. The blow-off terminal of claim 8, wherein said tang and said output section are substantially co-planar.

10. The blow-off terminal of claim 8, wherein said strip is U-shaped.

11. The blow-off terminal of claim 8, wherein said tang, said output section, and said input section are integrally formed with one another.

12. A method of manufacturing a blow-off terminal for a circuit breaker, comprising:

stamping a generally planar sheet of conductive raw material to form a first projection, a second projection, and a generally rectangular frame having a first pair of opposing sides and a second pair of opposing longitudinal sides, the first pair of opposing sides being generally perpendicular to the second pair of opposing longitudinal sides, the second projection extending from a central portion of a first side of the first pair of opposing sides in a generally longitudinal direction toward a second side of the first pair of opposing sides;

imparting two orthogonal bends, extending in the same direction, to each of the first pair of opposing sides at two locations symmetrically disposed about the respective central portions of the first pair of opposing sides; and mounting an electrical contact to the second projection.

13. The method of claim 12, wherein the first projection extends from a central portion of the second side of the first pair of opposing sides in a direction away from the first side of the first pair of opposing sides.

14. A blow-off terminal for a circuit breaker, comprising:

a flat conductive tang extending in a generally longitudinal direction and having opposing longitudinal sides;

a flat conductive output section extending in said longitudinal direction, said output section having opposing longitudinal sides and opposing ends bridging said opposing longitudinal sides, said output section having an electrical contact mounted thereto; and a conductive input section having a pair of generally planar curved strips, each of said strips having first and second ends, said first ends of said pair of strips being connected to said opposing longitudinal sides of said tang, said second ends of said pair of strips being connected to said opposing longitudinal sides of said output section.

15. The blow-off terminal of claim 14, wherein each of said pair of curved strips is U-shaped.

16. The blow-off terminal of claim 14, wherein said planar curved strips are generally perpendicular to said tang and said output section.

17. The blow-off terminal of claim 14, wherein said tang, said output section, and said input section are integrally formed with one another.

* * * * *